US005388727A

United States Patent [19]

Jouillat

[11] Patent Number: 5,388,727

[45] Date of Patent: Feb. 14, 1995

[54] TWO COMPARTMENT FLUID DISPENSER WITH PUMP, AND METHOD OF MANUFACTURING SAME

[75] Inventor: Claude Jouillat, La Marette, France

[73] Assignee: Societe Technique de Pulverisation -S.T.E.P.-, Verneuil-sur-Avre, France

[21] Appl. No.: 101,743

[22] Filed: Aug. 4, 1993

[30] Foreign Application Priority Data

Aug. 6, 1992 [FR] France ..... 9209759

[51] Int. Cl.[6] ..... B65D 35/22

[52] U.S. Cl. ..... 222/94; 222/96; 222/105; 222/131; 222/383

[58] Field of Search ..... 222/94, 95, 96, 131, 222/383, 105

[56] References Cited

U.S. PATENT DOCUMENTS

| | | | |
|---|---|---|---|
| 3,499,581 | 3/1970 | Lehmann | 222/94 X |
| 3,598,290 | 8/1971 | Steiman | 222/94 X |
| 3,936,334 | 2/1976 | Kushida et al. | 222/95 X |
| 4,087,023 | 5/1978 | Szczepanski | 222/209 |
| 5,100,027 | 3/1992 | Gueret | 222/383 X |
| 5,275,311 | 1/1994 | Piarrat | 222/95 X |

FOREIGN PATENT DOCUMENTS

| | | | |
|---|---|---|---|
| 0486355 | 5/1992 | European Pat. Off. . | |
| 1251113 | 12/1960 | France | 222/95 |
| 2389419 | 12/1978 | France . | |
| 2479152 | 10/1981 | France . | |
| 2647757 | 12/1990 | France . | |
| 8301431 | 4/1983 | WIPO | 222/383 |

*Primary Examiner*—Andres Kashnikow
*Assistant Examiner*—Joseph A. Kaufman
*Attorney, Agent, or Firm*—Sughrue, Mion, Zinn, Macpeak & Seas

[57] ABSTRACT

A fluid dispenser comprising a pump (10) having no air intake and mounted in sealed manner on a deformable tank (20), and an outer envelope (30) that surrounds the deformable tank (20) and that retains a shape suitable for being held in the hand throughout the time that the dispenser is in use, the outer envelope (30) defining an inner volume that communicates with the atmosphere via at least one air passage (34, 35, 36), the deformable tank being a flexible tube (20) that extends between a first end (20*a*) that is closed by pinching to form a bottom (33, 33*b*) and a second end (20*b*) that is secured to the pump (10), characterized in that the outer envelope is a flexible tube extending between a first end (30*a*) close to the bottom (33, 33*b*) of the tank, and a second end (30*b*) in mechanical connection with the second end of the deformable tank (20), the first end (30*a*) of the outer envelope being closed by pinching.

5 Claims, 3 Drawing Sheets

FIG.1
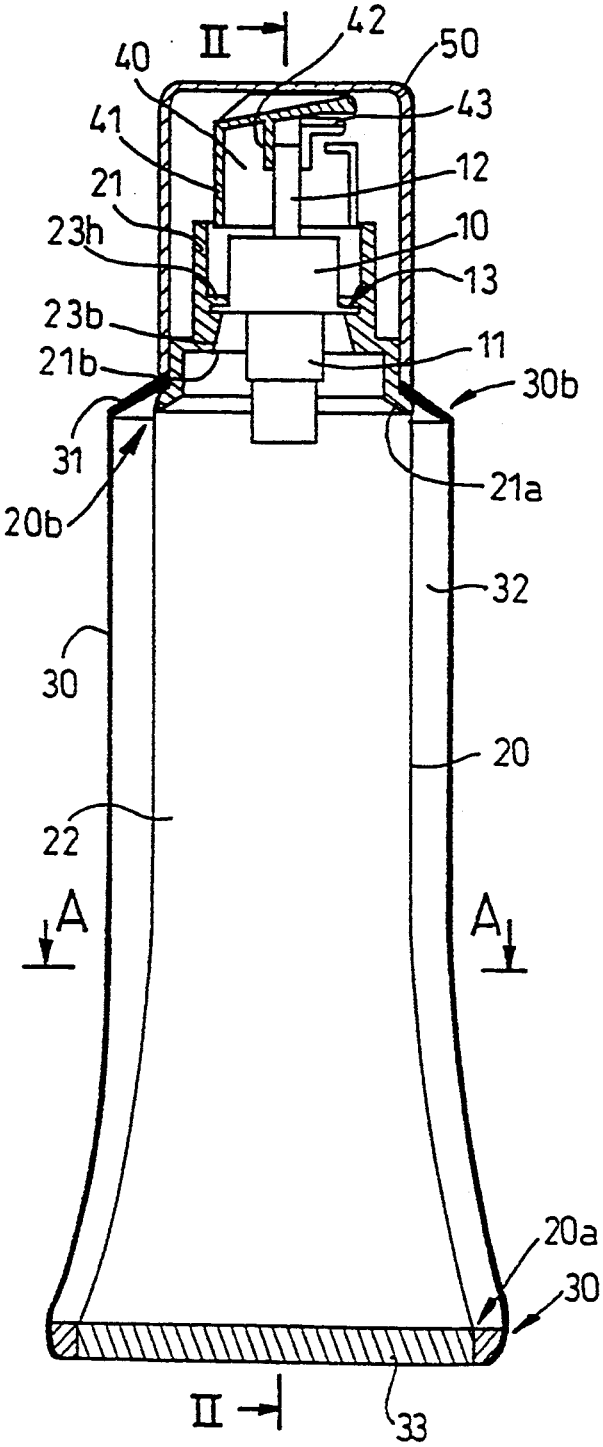
FIG.2
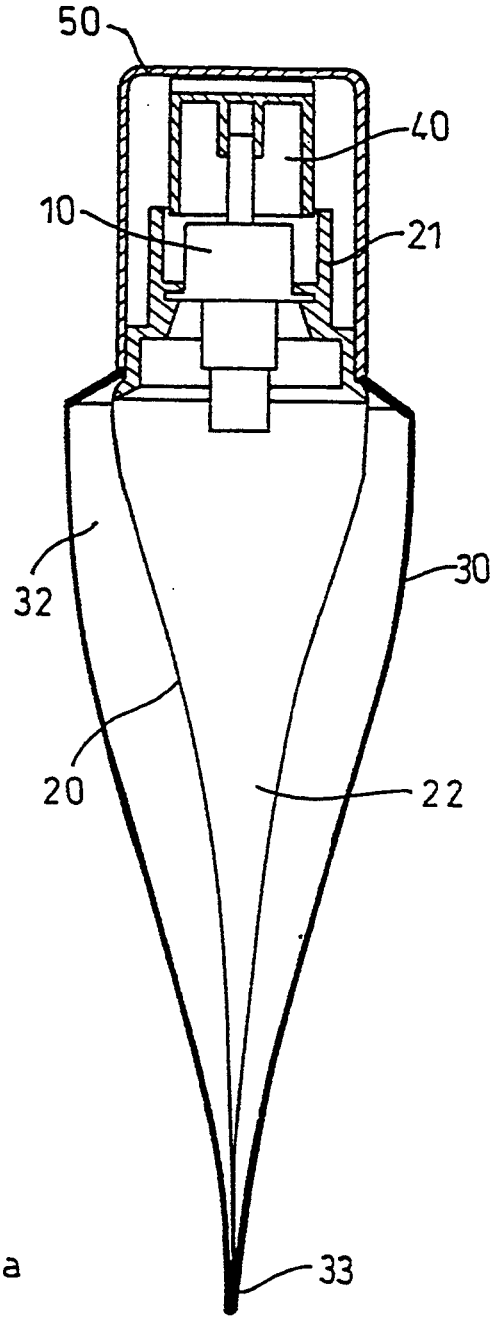
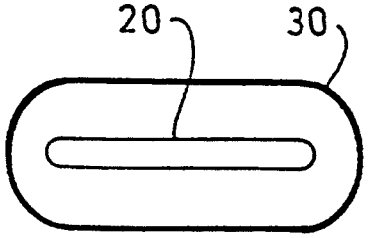
FIG.1a

FIG. 3
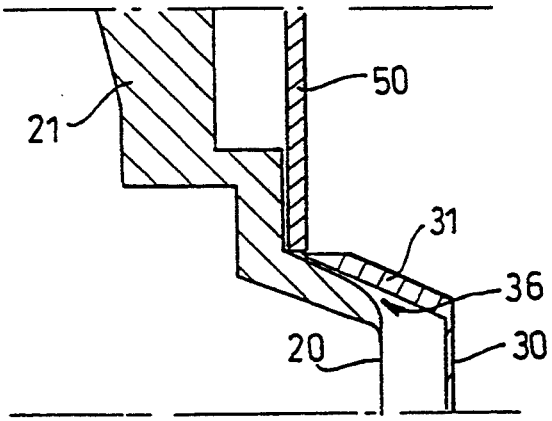
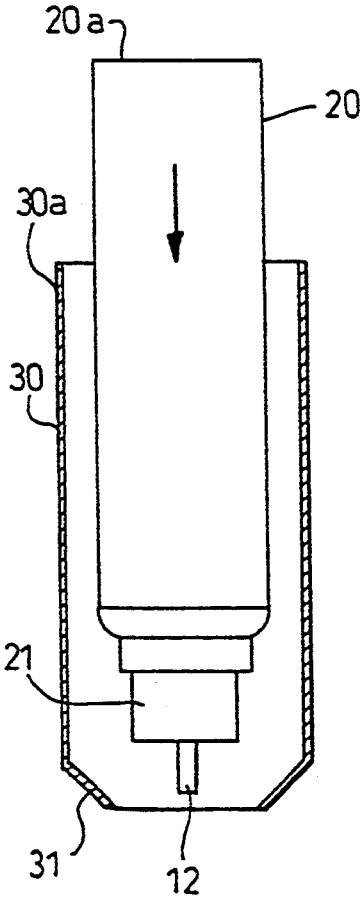
FIG. 4
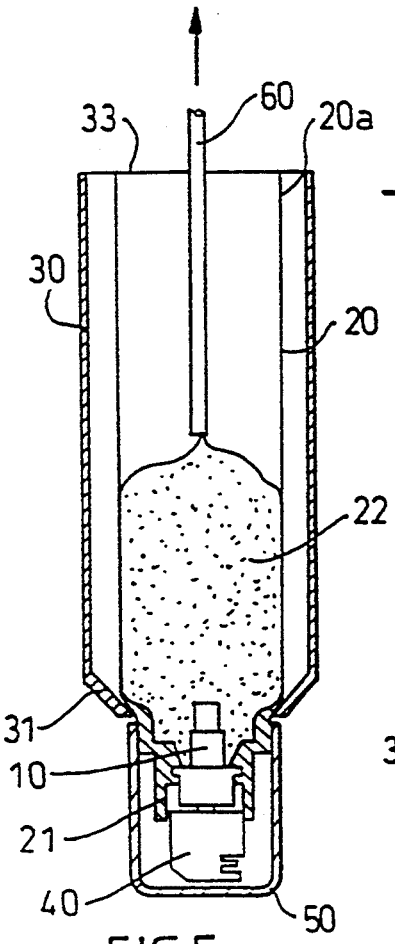
FIG. 5
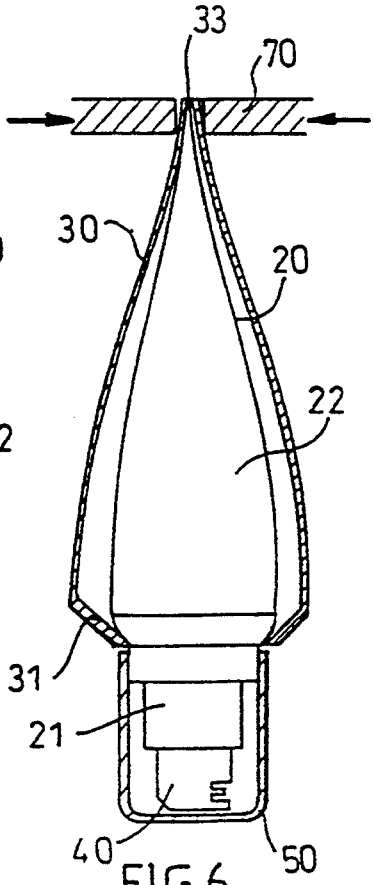
FIG. 6

TWO COMPARTMENT FLUID DISPENSER WITH PUMP, AND METHOD OF MANUFACTURING SAME

BACKGROUND OF THE INVENTION

The present invention relates to a dispenser for fluids, and to a method of manufacturing it.

To dispense small predetermined quantities ("doses") of fluid, in particular semisolid substances such as pastes or creams, it is known to make use of manually-actuated pumps of the kind to be found in sprays, and more particularly precompression pumps. European patent EP-0-251 863 filed in 1987 by Valois teaches associating such a pump with a deformable tank of the substance, e.g. a tube made of plastics material. If the pump is mounted in sealed manner on the tank, it is possible to empty practically all of the contents from the tank. Whenever a dose is expelled by actuating the pump, the tube is flattened correspondingly under the combined effects of atmospheric pressure on the outside of the deformable tank and the suction created by the pump inside the deformable tank.

That type of dispenser has other advantages. In particular, the substance in the tank can be conserved without coming into contact with air, thereby avoiding any risk of it being oxidized or contaminated. In addition, the dispenser works regardless of its position relative to the vertical.

However, when the tank is partially empty, the tube takes up a flattened form that is difficult to hold in the hand. Actuating the pump by pressing a finger on the dispenser head becomes awkward.

Provision could be made to dispose a more rigid envelope around the deformable tank so that the dispenser keeps a constant outside shape, as in double-envelope dispensers such as those described in U.S. Pat. No. 4,322,020 filed in 1980 by Stone. Unfortunately, such dispensers are relatively difficult to manufacture.

Dispensers are also known that have a double-walled tank with a flexible inner wall and a rigid outer wall, which tanks are made by blow coextrusion of the two walls, and welding by simultaneously pinching the ends of the two walls, the welding of the rigid outer wall being porus or permeable so as to enable air to penetrate between the two walls. Such a dispenser must be made using a method that is very difficult to master since the two walls must avoid welding together during blowing, and the weld at the end of the outer wall must leak while the weld at the end of the inner wall must be sealed. In addition, the materials that can be used for the inner and outer walls are very limited. Finally, the coextrusion method generally requires air to be blown between the two walls after they have been formed in order to separate them: this increases the cost of implementing the method.

SUMMARY OF THE INVENTION

The present invention provides a fluid dispenser comprising a pump having no air intake and mounted in sealed manner on a deformable tank, and an outer envelope that surrounds the deformable tank and that retains a shape suitable for being held in the hand throughout the time that the dispenser is in use, said outer envelope defining an inner volume that communicates with the atmosphere via at least one air passage, the deformable tank being a flexible tube that extends between a first end that is closed by pinching to form a bottom and a second end that is secured to the pump, characterized in that the outer envelope is a flexible tube extending between a first end close to the bottom of the tank, and a second end in mechanical connection with the second end of the deformable tank, the first end of the outer envelope being closed by pinching. Advantageously, the first end of the outer envelope is welded by pinching. Advantageously, the outer envelope is made of a material having sufficient elastic shape memory to enable said envelope to return to its initial shape after being deformed by being held by a user.

In an embodiment, the second end of the deformable tank is secured to a substantially rigid endpiece in which the pump is mounted, said endpiece including at least one outside shoulder, the second end of the outer envelope including a neck that is engaged on said shoulder. Advantageously, said air passage is situated between said neck and said shoulder which are in non-sealed contact one against the other.

The present invention also provides a method of manufacturing a dispenser constituting the above embodiment, further characterized in that it comprises the following steps:

1) the assembly comprising the pump and the tank is engaged in the first end of the envelope until the pump emerges through the neck of the envelope;
2) the tank is filled from its first end; and
3) the first end of the tank and the first end of the envelope are closed simultaneously by pinching.

In a variant, the first end of the outer envelope may be closed after the first end of the tank. Advantageously, the neck of the outer envelope is urged against the shoulder of the endpiece while the first end of the tank and the first end of the outer envelope are being closed simultaneously, or while the first end of the outer envelope is being closed if that takes place after the deformable tank has been closed. This limits the clearance between the tank and the outer envelope.

In another implementation of the dispenser of the invention, the second end of the deformable tank and the second end of the outer envelope are secured to a substantially rigid endpiece in which the pump is mounted. In this implementation, the dispenser may be manufactured by a method comprising the following steps:

1) the tank is filled from its first end; and
2) the first end of the tank and the first end of the envelope are closed simultaneously by pinching; or the following steps:

1) the tank is filled via its first end;
2) the first end of the tank is closed; and then
3) the first end of the outer envelope is closed.

The outer envelope may be transparent and/or may carry symbols.

BRIEF DESCRIPTION OF THE DRAWINGS

The invention will be better understood on reading the following detailed description and on examining the accompanying drawings which show various embodiments of the invention as non-limiting examples. In the drawings:

FIG. 1 is a first longitudinal section through a partially-emptied dispenser of the invention;

FIG. 1*a* is a section view on line A—A of FIG. 1;

FIG. 2 is a second longitudinal section through the dispenser of FIG. 1 on line II—II of FIG. 1;

FIG. 3 shows a detail of the preceding sections;

FIGS. 4 to 6 are fragmentary longitudinal sections showing three steps in a method of manufacturing the dispenser of the preceding figures;

DETAILED DESCRIPTION OF THE PREFERRED EMBODIMENTS

Figure 7:
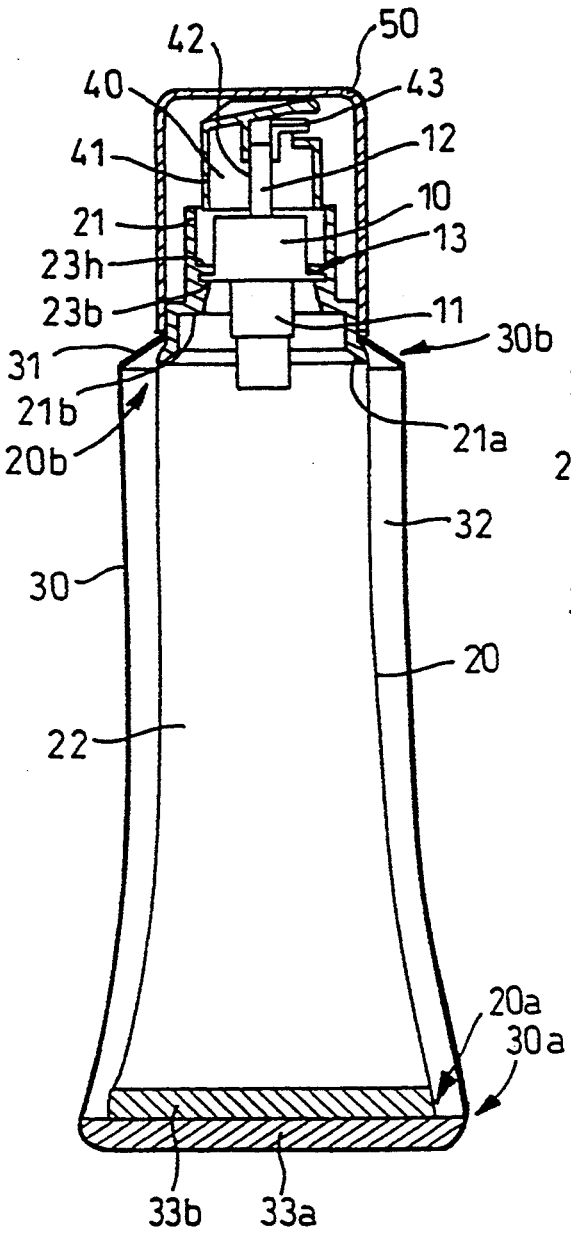
FIG. 7 shows a variant of the FIG. 1 device, in section.

In FIGS. 1 and 2, the device of the invention comprises a deformable inner tube 20 and a flexible outer tube 30. The two tubes 20 and 30 are concentric as can clearly be seen in FIG. 1*a*. The tube 20 may be made of single- or multi-layer plastics material, or of metal, in particular thin aluminum, or else of a multilayer material comprising one or more layers of metal (e.g. aluminum) and one or more layers of plastics material. The inner tube 20 is deformable, and preferably plastically deformable, i.e. it has no shape memory or little shape memory, but the invention is not limited to the particular way in which the tube 20 deforms providing it is capable of flattening under the effect of suction from the pump 10. The outer tube 30 may be made of any appropriate flexible material, e.g. a plastics material such as polyethylene. In the embodiment of FIG. 1, it is necessary for the tubes 20 and 30 to be made of materials that can be welded together. The outer tube 30 may be transparent, thus making it possible to see how much remains in the inner tube 20 while the device is in use or when it is being purchased. The outer tube 30 may optionally be less deformable than the inner tube 20 so as to facilitate holding in the hand, and in all cases it is essential for the tube 30 to be flexible for reasons relating to the method of manufacturing the device of the invention, as described below. Advantageously, the tube 30 has elastic shape memory enabling it to return to its initial shape after it has been deformed by being held during use.

Each of the tubes 20 and 30 extends between a respective bottom end 20*a* or 30*a* and a respective top end 20*b* or 30*b*. The terms "bottom" and "top" as used herein are not limiting, but merely indicate the positions of the ends as shown in FIGS. 1 and 2, for reasons of clarity.

The tubes 20 and 30 are welded together by pinching their bottom ends 20*a* and 30*a*, thus forming a bottom 33 of the tank.

The top end 20*a* of the inner tube 20 includes a more rigid endpiece 21. The endpiece 21 may be formed integrally with the tube 20, rigidity of the endpiece being obtained merely by a greater thickness of material. The endpiece 21 may also be a piece that is applied to the tube 20 by welding, or it may be a piece that is overmolded on the top end 20*a* of the tube 20, in which case the tube 20 may be obtained merely by extruding a tube and cutting the tube at predetermined intervals prior to fixing the endpiece 21.

In the embodiment shown in the figures, the endpiece 21 is cylindrical, having an outside diameter that is reduced in two sets so as to define two shoulders 21*a* and 21*b*. A cap 50 fits onto the outside of the portion of the endpiece that extends between the two shoulders. A pump 10, seen in side view in the figures, fits inside the endpiece 21. The pump 10 operates without air intake, i.e. without allowing air into the tube 20 while the tube is being emptied. In the figures, the corresponding fastening is shown as taking place around a turret presented by the pump between its body 11 and its actuating rod 12. An annular rim 13 on the turret may be, for example, pinched between two flanges 23*h* and 23*b* that project inwardly from the endpiece 21 for the purpose of achieving a sealed connection. In this embodiment, a pushbutton 40 is engaged via an inside sleeve 42 on the actuator rod 12 of the pump 10. It may include a lateral outlet 43 while its own side wall 41 is adapted, for example, to slide inside the endpiece 21. The pump could be fixed in sealed manner to the endpiece 21 in any other known way: a force-fit; crimping; overmolding the endpiece 21 on the pump body; etc. . . .

The top end 30*a* of the outer tube 30 includes a relatively rigid neck 31 which constitutes a narrowing of the tube. FIG. 3 shows this neck 31 in greater detail, including the way it co-operates with the endpiece 21. It merely rests on the bottom shoulder of the endpiece 21 and surrounds it. The resulting connection is not sealed and it allows air 36 to pass through. This makes it possible to keep the space 32 between the two tubes at atmospheric pressure. As a result it is possible to dispense the fluid 22 contained in the inner tube 20 by actuating the pump. On each occasion, that has the effect of additionally flattening the inner tube 20 so that typically it takes up the shape shown in FIGS. 2 and 1*a*, in particular. The outer tube 30 is not subjected to such deformation. Throughout use of the dispenser, it retains a pot-bellied shape that is easier to hold.

In practice, the outer tube 30 together with its neck 31 is manufactured separately. Advantageously, it is made of polyethylene that is sufficiently flexible to lend itself to the pinching required for welding the bottom 33, but that is sufficiently rigid to provide the user with a good hand-hold. In certain cases, it may be advantageous for the polyethylene to remain translucent or transparent, e.g. to enable the quantity of fluid remaining in the inner tube 20 to be verified. In other cases, on the contrary, the outer tube 30 preferably carries symbols (a trademark, decoration, etc.). Under such circumstances, the method used for applying such symbols can be selected without any fear of damaging the pump, in particular. In addition, the silkscreen methods commonly used for decorating tubes give rise to a reject rate that is relatively high and may be as much as 6%. By performing silkscreen printing on the outer tube 30, a 6% reject rate for pumps mounted on the inner tubes 20 is avoided, which represents a significant saving.

The dispenser described above is particularly easy to manufacture. FIGS. 4 to 6 show the three main steps in the corresponding method:

1) Firstly an assembly comprising a pump 10 and a tube 20 is engaged in an outer tube 30 as described above. As shown in FIG. 4, the assembly is inserted into the end 30*a* of the outer tube 30, after which the endpiece 21 is passed through the neck 31. This manufacturing step is generally performed by the dispenser manufacturer. The same manufacturer may then continue to install the pushbutton 40 and the cap 50. As a result, the manufacturer of the fluid who normally performs the operation of filling the dispenser is not involved with part-manipulating operations that always lead to difficulties.
2) Filling then takes place via the end 20*a* of the tube 20 which has been left open for this purpose. This can be done by means of an injector 60 that may be inserted inside the inner tube 20, for example, extending as far as the immediate vicinity of the pump 10. As it delivers fluid 22, the injector 60 is advantageously raised so that its end remains above the fluid. This method which is shown diagrammatically in FIG. 5 avoids any air remaining trapped in the fluid.

3) Finally, the bottoms 33 of the two tubes 20 and 30 are welded together in a single operation. The diagram of FIG. 6 shows that this operation is performed by applying jaws 70 against opposite sides of the tubes. Depending on the materials from which they are made, welding may be achieved by heating, by ultrasound, etc. Where appropriate, if the initial lengths of the two tubes are not comparable, they may be cut to the same length either subsequently or previously at the end of operation 1) where the tubes are engaged one inside the other. Vacuum welding methods as described in French patent FR 2 633 249 may also be implemented to ensure that no air remains inside the inner tube 20 after it has been closed.

Advantageously, the neck 31 may be urged against the shoulder 21*a* during welding so as to establish prestress that reduces play between the two tubes 20 and 30.

In a variant, as shown in FIG. 7, the ends 20*a* and 30*a* of the tubes 20 and 30 respectively may be welded together separately. This may be advantageous, in particular, if the conditions applicable to welding the two tubes 20 and 30 are too different, thus making it impossible to weld both of them simultaneously by pinching. Thus, it is possible to use a wider range of materials for the tubes 20 and 30. In this variant, a bottom 33*b* is welded initially at the end 20*a* of the inner tube 20, after which a bottom 33*a* is welded at the end 30*a* of the outer tube 30. Advantageously, the bottom 33*a* is welded in the immediate vicinity of the bottom 33*b* so as to avoid any play in the assembly between the tubes 20 and 30. Advantageously, the neck 31 may be urged against the shoulder 21*a* during welding of the bottom 33*a* so as to establish prestress that facilitates obtaining an assembly of the two tubes 20 and 30 without play.

Figure 8:
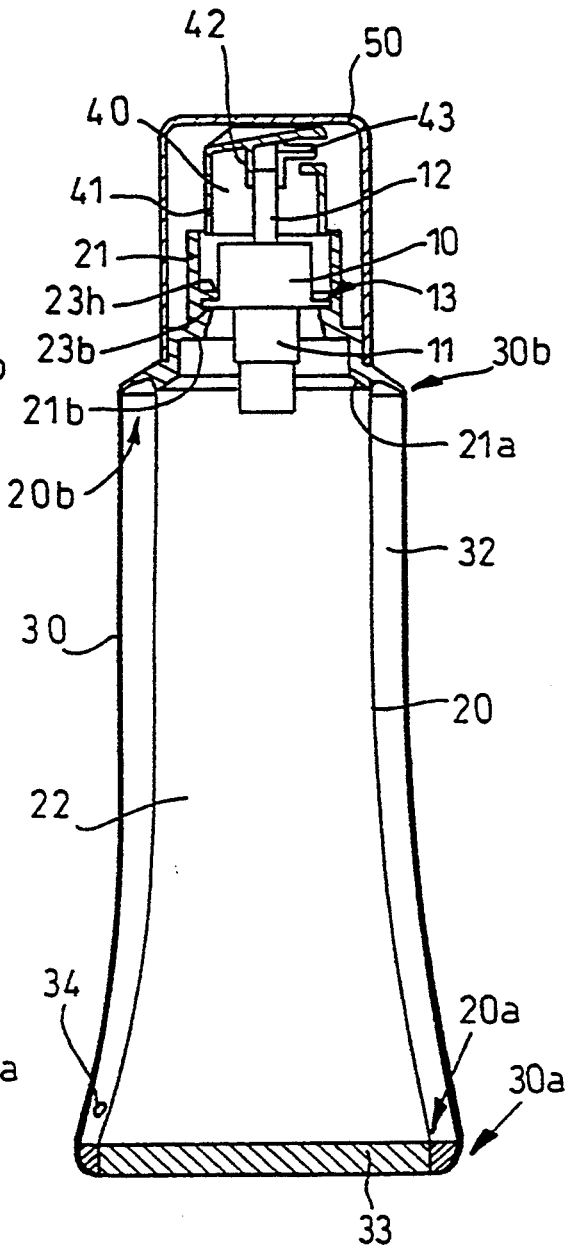
FIG. 8 is a fragmentary section through another variant of the FIG. 1 device.
Figure 9:
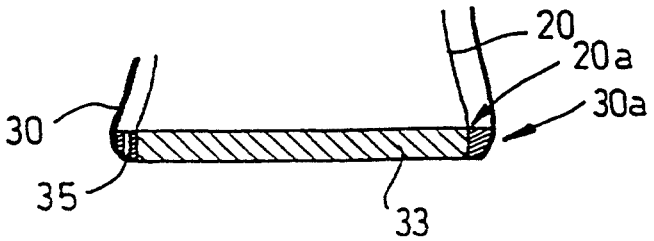
FIG. 9 is a detail view of a variant of the FIG. 8 device.

In another variant, as shown in FIG. 8, the tubes 20 and 30 are secured to the endpiece 21 via their respective ends 20*b* and 30*b*. The tubes 20 and 30 may be integrally formed with the endpiece 21 or else they may be fixed to the endpiece 21: for example, the ends 20*b* and 30*b* may be fixed to the endpiece 21 by welding, or the endpiece 21 may be overmolded on the ends 20*b* and 30*b*. In this variant, the ends 20*a* and 30*a* may be welded simultaneously or separately, as described above. In the device of FIG. 8, an air inlet orifice 34 is formed through the outer tube 30. In a variant of the FIG. 8 device as shown in FIG. 9 a needle is inserted into the end 30*a* of the tube 30 at a distance from the tube 20, prior to welding the bottom 33. Then, during welding, the pinched-together edges of the end 30*a* are not welded together at the location of the needle. After the needle has been removed, there remains an air inlet orifice 35.

I claim:

1. A fluid dispenser comprising a pump (10) mounted in a sealed manner on a deformable tank (20), and an outer envelope (30) that surrounds the deformable tank (20) and that retains a shape suitable for being held in the hand throughout the time that the dispenser is in use, said deformable tank comprising a flexible tube (20) that extends between a first end (20*a*) that is closed by pinching to form a bottom (33, 33*b*) and a second end (20*b*) that is secured to a substantially rigid end piece (21) in which the pump (10) is mounted, said end piece (21) including at least one outside shoulder (21*a*);

said outer envelope comprising a flexible tube extending between a first end (30*a*) close to the bottom (33, 33*b*) of the tank and closed by pinching, and a second end (30*b*) including a neck (31) that is engaged on said shoulder (21*a*), said second end (30*b*) being in mechanical connection with the second end of the deformable tank (20), wherein said outer envelope (30) defines an inner volume that communicates with the atmosphere via at least one primary air passage (36) situated between said neck (31) and said shoulder (21*a*) which are in non-sealed contact one against the other.

2. A device according to claim 1, in which the first end (30*a*) of the outer envelope is welded by pinching.

3. A device according to claim 1, in which the outer envelope is made of a material having sufficient elastic shape memory to enable said envelope to return to its initial shape after being deformed by being held by a user.

4. A device according to claim 1, 2 or 3 in which the envelope (30) is transparent.

5. A device according to claim 3, in which the first end (30*a*) of the outer envelope is welded by pinching.

* * * * *